US009045806B2

(12) United States Patent
Montagnon

(10) Patent No.: US 9,045,806 B2
(45) Date of Patent: Jun. 2, 2015

(54) HARDENED MARTENSITIC STEEL HAVING A LOW OR ZERO CONTENT OF COBALT, METHOD FOR PRODUCING A COMPONENT FROM THIS STEEL, AND COMPONENT OBTAINED IN THIS MANNER

(75) Inventor: Jacques Montagnon, La Varenne St. Hilaire (FR)

(73) Assignee: AUBERT & DUVAL, Paris (FR)

( * ) Notice: Subject to any disclaimer, the term of this patent is extended or adjusted under 35 U.S.C. 154(b) by 850 days.

(21) Appl. No.: 12/668,297

(22) PCT Filed: Jun. 18, 2008

(86) PCT No.: PCT/FR2008/051080

§ 371 (c)(1),
(2), (4) Date: Apr. 13, 2010

(87) PCT Pub. No.: WO2009/007562

PCT Pub. Date: Jan. 15, 2009

(65) Prior Publication Data

US 2010/0200119 A1 Aug. 12, 2010

(30) Foreign Application Priority Data

Jul. 10, 2007 (FR) ..... 07 56379

(51) Int. Cl.

| | |
|---|---|
| ***C23C 8/32*** | (2006.01) |
| ***C21D 6/00*** | (2006.01) |
| ***C23C 8/26*** | (2006.01) |
| ***C22C 38/40*** | (2006.01) |
| ***C21D 6/02*** | (2006.01) |
| ***C21D 6/04*** | (2006.01) |
| ***C22C 38/44*** | (2006.01) |
| ***C22C 38/50*** | (2006.01) |
| ***C22C 38/52*** | (2006.01) |
| *C21D 1/58* | (2006.01) |

(52) U.S. Cl.

CPC *C21D 6/004* (2013.01); *C21D 1/58* (2013.01); *C21D 6/02* (2013.01); *C21D 6/04* (2013.01); *C22C 38/44* (2013.01); *C22C 38/50* (2013.01); *C22C 38/52* (2013.01)

(58) Field of Classification Search

CPC ..... C21D 6/004; C21D 1/58; C21D 6/02; C21D 6/04; C22C 38/44; C22C 38/50; C22C 38/52

USPC ..... 148/320, 219, 621, 226, 328; 420/84

See application file for complete search history.

(56) References Cited

U.S. PATENT DOCUMENTS

| | | | | | |
|---|---|---|---|---|---|
| 4,004,920 | A * | 1/1977 | Fruehan | 75/557 |
| 4,407,681 | A * | 10/1983 | Ina et al. | 148/570 |
| 4,605,321 | A * | 8/1986 | Brandenstein et al. | 384/512 |
| 4,832,525 | A * | 5/1989 | Morrison | 404/114 |
| 5,393,488 | A | 2/1995 | Rhoads et al. | |
| 6,715,921 | B2 * | 4/2004 | Mochizuki et al. | 384/415 |
| 2003/0094218 | A1 | 5/2003 | Nilsson et al. | |

FOREIGN PATENT DOCUMENTS

| | | | | |
|---|---|---|---|---|
| GB | 1089934 | * | 11/1967 | C22C 39/10 |
| GB | 1 243 382 | A | 8/1971 | |
| WO | 2006/114499 | A2 | 11/2006 | |

* cited by examiner

*Primary Examiner* — Jessee Roe

(74) *Attorney, Agent, or Firm* — Sughrue Mion, PLLC; Richard C. Turner

(57) ABSTRACT

Steel, characterized in that the composition thereof is, in percentages by weight:

C=0.20-0.30%
Co=trace levels-1%
Cr=2-5%
Al=1-2%
Mo+W/2=1-4%
V=trace levels-0.3%
Nb=trace levels-0.1%
B=trace levels-30 ppm
Ni=11-16% with Ni≥7+3.5 Al
Si=trace levels-1.0%
Mn=trace levels-2.0%
Ca=trace levels-20 ppm
rare earths=trace levels-100 ppm
if N≤10 ppm, Ti+Zr/2=trace levels-100 ppm with Ti+Zr/2≤10 N
if 10 ppm<N≤20 ppm, Ti+Zr/2=trace levels-150 ppm
O=trace levels-50 ppm
N=trace levels-20 ppm
S=trace levels-20 ppm
Cu=trace levels-1%
P=trace levels-200 ppm the remainder being iron and inevitable impurities resulting from the production operation.

Method of producing a component from this steel and a component obtained in this manner.

28 Claims, No Drawings

HARDENED MARTENSITIC STEEL HAVING A LOW OR ZERO CONTENT OF COBALT, METHOD FOR PRODUCING A COMPONENT FROM THIS STEEL, AND COMPONENT OBTAINED IN THIS MANNER

CROSS REFERENCE TO RELATED APPLICATIONS

This application is a National Stage of International Application No. PCT/FR2008/051080 filed Jun. 18, 2008, claiming priority based on French Patent Application No. 07 56379 filed Jul. 10, 2007, the contents of all of which are incorporated herein by reference in their entirety.

BACKGROUND OF THE INVENTION

The invention relates to a martensitic steel which is hardened by means of a duplex system, that is to say, by means of precipitation of intermetal compounds and carbides obtained owing to an appropriate composition of the steel and a thermal processing operation for ageing.

SUMMARY OF THE INVENTION

This steel provides:

- a very high level of mechanical strength but, at the same time, a high level of toughness and ductility, that is to say, a low level of susceptibility to brittle fracture; this very high level of strength remains in the hot state, up to temperatures in the order of 400° C.,
- good properties in terms of fatigue, which involves in particular the absence of harmful inclusions, such as nitrides and oxides; this characteristic must be obtained via an appropriate composition and careful production conditions of the liquid metal.

Furthermore, it is case-hardenable, nitridable or carbonitridable, in order to be able to harden the surface thereof in order to provide it with a high level of resistance to abrasion and during lubricated friction.

The applications which can be envisaged for this steel relate to all the fields of mechanical engineering in which structural or transmission components are required which must combine very powerful loads under dynamic stresses and in the presence of induced or ambient heating. It is possible to mention, in a non-exhaustive manner, transmission shafts, gearbox shafts, bearing shafts, etc.

The requirement for an excellent level of mechanical strength in the hot state prevents the use, in some applications, of carbon steels or steels which are referred to as being "slightly alloyed" whose strength decreases from 200° C. Furthermore, the toughness of these steels is generally not satisfactory when they are processed for levels of mechanical strength greater than 2000 MPa, and, generally, their "true" yield strength is much less than their maximum strength measured at the traction test: the yield strength is therefore a significant criterion which becomes detrimental in this instance. It is possible to use maraging steels whose yield strength is substantially closer to their maximum value of tensile strength and which have a satisfactory level of strength up to 350-400° C., and which also offer a good level of toughness for the very high levels of mechanical strength. However, these maraging steels quite systematically contain high contents of nickel, cobalt and molybdenum, all elements which are costly and subject to significant variations in their cost on the raw materials market. They also contain titanium which is used for its significant contribution to secondary hardening, but which is principally involved in the reduction of the fatigue strength of maraging steels owing to the nitride TiN, the formation of which it is almost impossible to prevent during the production of steels which contain even only a few tenths of a percentage thereof.

Document U.S. Pat. No. 5,393,388 has proposed a steel composition having secondary hardening without any addition of titanium which is intended to improve the resistance in the hot state and in particular improve the properties in terms of fatigue, the ductility and the toughness. This composition has the disadvantage of requiring a high content of Co (from 8 to 16%), which makes the steel very costly. (NB: in the present text, all the contents of the various elements are expressed as percentages by weight.)

Document WO-A-2006/114499 has proposed a composition of hardened martensitic steel and an optimised sequence of thermal processing operations which is suitable for this composition and which, in comparison with the prior art set out in U.S. Pat. No. 5,393,388 had the advantage of requiring only a lower content of cobalt, that is, between 5 and 7%. By adjusting the contents of the other elements and the parameters of the thermal processing operations accordingly, it was possible to obtain components which have a range of very satisfactory mechanical properties, in particular for aeronautical applications. These include, in particular, a tensile strength of between 2200 MPa and 2350 MPa in the cold state, ductility and resilience at least equal to those of the best high-strength steels and, in the hot state (400° C.), a tensile strength in the order of 1800 MPa, and optimal fatigue properties.

This steel is referred to as having "duplex hardening", since its hardening is obtained by means of simultaneous hardening precipitation of intermetal compounds and carbides of the $M_2C$ type.

However, this steel still contains relatively significant quantities of cobalt. Since this element is in any case costly, and its price is susceptible to significant fluctuations on the raw materials market, it would be significant to find means of very substantially further reducing its presence, in particular in materials which are intended for more common mechanical applications than aeronautical applications.

DESCRIPTION OF THE INVENTION

The object of the invention is to provide a steel which can be used, in particular, to produce mechanical components such as transmission shafts, or structural elements, having a mechanical strength in the hot state which is further improved but also properties involving fatigue and brittleness which are still suitable for these applications. This steel should also have a lower production cost than the most effective steels currently known for these applications, owing, in particular, to a significantly further reduced content of cobalt.

To this end, the invention relates to a steel, characterised in that the composition thereof is, in percentages by weight:

C=0.20-0.300
Co=trace levels-1%
Cr=2-5%
Al=1-2%
Mo+W/2=1-4%
V=trace levels-0.3%
Nb=trace levels-0.1%
B=trace levels-30 ppm
Ni=11-16% with Ni≥7+3.5 Al
Si=trace levels-1.0%
Mn=trace levels-2.0%
Ca=trace levels-20 ppm rare earths=trace levels-100 ppm if N≤10 ppm, Ti+Zr/2=trace levels-100 ppm with Ti+Zr/2≤10 N if 10 ppm<N≤20 ppm, Ti+Zr/2=trace levels-150 ppm O=trace levels-50 ppm N=trace levels-20 ppm S=trace levels-20 ppm Cu=trace levels-1%

P=trace levels-200 ppm the remainder being iron and inevitable impurities resulting from the production operation.

It preferably contains C=0.20-0.25%.

It preferably contains Cr=2-4%.

It preferably contains Al=1-1.6%, preferably 1.4-1.6%.

It preferably contains Mo≥1%.

It preferably contains Mo+W/2=1-2%.

It preferably contains V=0.2-0.3%.

It preferably contains Ni=12-14%, with Ni≥7+3.5 Al.

It preferably contains Nb=trace levels-0.05%.

It preferably contains Si=trace levels-0.25%, preferably trace levels-0.10%.

It preferably contains O=trace levels-10 ppm.

It preferably contains N=trace levels-10 ppm.

It preferably contains S=trace levels-10 ppm, preferably trace levels-5 ppm.

It preferably contains P=trace levels-100 ppm.

The measured martensitic transformation temperature Ms thereof is preferably greater than or equal to 100° C.

The measured martensitic transformation temperature Ms thereof may be greater than or equal to 140° C.

The invention also relates to a method for producing a component from steel, characterised in that it comprises the following steps prior to the finishing of the component which confers the definitive shape thereon:

the preparation of a steel having the above composition;

at least one operation for shaping this steel;

a softening tempering operation at 600-675° C. for from 4 to 20 hours followed by cooling in air;

a solution heat treatment at 900-1000° C. for at least 1 hour, followed by cooling in oil or air which is sufficiently rapid to prevent the precipitation of intergranular carbides in the austenite matrix;

a hardening ageing operation at 475-600° C., preferably at from 490-525° C. for from 5-20 hours.

It preferably further comprises a cryogenic processing operation at −50° C. or lower, preferably at −80° C. or lower, in order to convert all the austenite into martensite, the temperature being 150° C. or more less than measured Ms, at least one of the processing operations lasting at least 4 hours and a maximum of 50 hours.

It further preferably comprises a processing operation for softening the coarse martensite involving annealing carried out at 150-250° C. for from 4 to 16 hours, followed by cooling in still air.

The component is preferably also subjected to a case-hardening operation or a nitriding or a carbonitriding operation.

The nitriding operation can be carried out during an ageing cycle.

Preferably, it is carried out between 490 and 525° C. for from 5 to 100 hours.

The nitriding or case-hardening or carbonitriding operation can be carried out during a thermal cycle prior to or at the same time as the solution heat treatment.

The invention also relates to a mechanical component or component for a structural element, characterised in that it is produced in accordance with the above method.

It may be in particular an engine transmission shaft, an engine suspension device, a landing gear element, a gearbox element or a bearing shaft.

As will be appreciated, the invention is based firstly on a steel composition which is distinguished from the prior art constituted by WO-A-2006/114499 in particular by a very low content of Co which does not exceed 1% and which can typically be limited to trace levels inevitably resulting from the production operation. The contents of the other most common alloy elements which are present in significant quantities are modified only slightly but some contents of impurities must be carefully controlled.

This possibility of dispensing completely with the usual addition of cobalt in martensitic steels of the class of those of the invention is a particularly surprising result. The steel according to the invention therefore no longer contains significant quantities of costly addition elements, with the exception of nickel whose content is, however, not increased compared with the prior art. It is only necessary to take particular care during the production operation to limit the content of nitrogen to a maximum of 20 ppm to prevent as far as possible the formation of aluminium nitrides. The maximum contents of titanium and zirconium must also consequently be limited to prevent them from forming nitrides with the residual nitrogen.

These steels have an intermediate plastic deviation (deviation between the resistance to break $R_m$ and yield strength $R_{p0.2}$) between those of carbon and maraging steels. For the latter types, the deviation is very low, providing a high yield strength but rapid rupture as soon as it is exceeded. The steels of the invention have, in this regard, properties which can be adjusted by the proportion of hardening phases and/or carbon.

The steel of the invention may be processed in the annealed state, with tools which are suitable for a hardness of 45 HRC. It is intermediate between maraging steels (which can be processed in the coarse annealed state since they have soft martensite with low carbon) and carbon steels which must substantially be processed in the annealed state.

In the steels of the class of those of the invention, "duplex" hardening is carried out, that is to say, jointly obtained by intermetals of the type β-NiAl and carbides of the $M_2C$ type, in the presence of reverted austenite which is formed/stabilised by enrichment with nickel obtained by diffusion during the hardening ageing operation, which confers ductility on the structure owing to the formation of a sandwich structure (a few % of stable and ductile austenite between the struts of the hardened martensite).

The formation of nitrides must be prevented, in particular of Ti, Zr and Al, which are embrittling: they reduce the toughness and the fatigue strength. Since these nitrides can precipitate from contents of from 1 to a few ppm of N in the presence of Ti, Zr and/or Al, and conventional production methods make it difficult to achieve less than 5 ppm of N, the steel of the invention complies with the following provisions.

Any addition of Ti is limited in principle (maximum allowed: 100 ppm) and N is limited as much as possible. According to the invention, the content of N must not exceed 20 ppm and, preferably, 10 ppm, and the content of Ti must not exceed 10 times the content of N.

However, a proportioned addition of titanium at the end of production in the furnace at reduced pressure may be envisaged in order to fix the residual nitrogen and thus prevent the harmful precipitation of the nitride AlN. However, since it is necessary to prevent the formation of the nitride TiN in the liquid phase, since it becomes coarse (from 5 to 10 μm or more), the addition of titanium can be carried out only for a maximum residual content of nitrogen of 10 ppm in the liquid metal, and always without exceeding 10 times this residual value of nitrogen. For example, for a final content of 8 ppm of N at the end of production, the limit content of the optional addition of titanium is 80 ppm.

It is possible to partially or completely replace Ti with Zr, these two elements behaving in a quite similar manner. Since their atomic masses are in a ratio of 2, if Zr is added in addition to or in place of Ti, the total Ti+Zr/2 must be taken as a basis for proportions and it must be said that, whilst N≤10 ppm, Ti+Zr/2 must always be ≤100 ppm;

and that Ti+Zr/2 must be ≤10 N.

If the content of N is greater than 10 ppm and less than or equal to 20 ppm, Ti and Zr should be considered to be impurities to be avoided, and the total Ti+Zr/2 must not exceed 150 ppm.

The optional addition of rare earths, at the end of the production operation, may also contribute to fixing a fraction of N, as well as S and O. In this instance, it must be ensured that the residual content of rare earths remains less than 100 ppm and preferably less than 50 ppm, since these elements embrittle the steel when they are present above these values. It is thought that the oxynitrides of rare earths (for example, La) are less harmful than the nitrides of Ti or Al, owing to their globular shape which may make them less susceptible to be sites for the initiation of fatigue ruptures. However, it is nonetheless advantageous to allow these inclusions to remain in the steel as little as possible using conventional careful production techniques.

Processing with calcium can be carried out in order to complete the deoxidation/desulphurisation of the liquid metal. This processing is preferably carried out with optional additions of Ti, Zr or rare earths.

The carbide $M_2C$ of Cr, Mo, W and V containing very little Fe is preferred for its hardening and non-embrittling properties. The carbide $M_2C$ is metastable with respect to the equilibrium carbides $M_7C_3$ and/or $M_6C$ and/or $M_{23}C_6$. It is stabilised with Mo and W. The sum of the content of Mo and half the content of W must be at least 1%. However, Mo+W/2=4% should not be exceeded so as not to diminish the forgeability (or the deformability in the hot state in general) and not to form intermetallic compounds of the μ phase of the type $Fe_7Mo_6$ which is one of the necessary hardening phases of conventional maraging steels but is not desirable in the steel of the invention. Preferably, Mo+W/2 is between 1 and 2%. Preventing the formation of non-hardening carbides of Ti which are capable of embrittling the grain joints also requires an imperative limitation to 100 ppm of the content of Ti of the steels according to the invention.

Cr and V are elements which activate the formation of "metastable" carbides.

V also forms carbides of the MC type which are stable up to dissolution temperatures and which "block" the grain boundaries and limit the enlargement of grains during thermal processing operations at high temperature. V=0.3% must not be exceeded so as not to fix an excessive level of C in carbides of V, during the dissolution cycle, to the detriment of the carbide $M_2C$ of Cr, Mo, W, V which it is desirable to precipitate during the subsequent ageing cycle. Preferably, the content of V is between 0.2 and 0.3%.

The presence of Cr (at least 2%) allows the level of V carbides to be reduced and the level of $M_2C$ to be increased. 5% must not be exceeded so as not to excessively promote the formation of stable carbides, in particular $M_{23}C_6$. Preferably, 4% of Cr is not exceeded so as to better ensure the absence of $M_{23}C_6$ and not to excessively reduce the start temperature Ms of the martensitic transformation.

The presence of C promotes the appearance of $M_2C$ with respect to the μ phase. However, an excessive content brings about segregations, a lowering of Ms and brings about problems during production on an industrial scale: susceptibility to stress cracks (superficial fissuring during rapid cooling), difficult machinability of an excessively hard martensite in the crude quenched state, etc. The content thereof must be between 0.20 and 0.30%, preferably 0.20-0.25% so as not to confer on the component an excessive level of hardness which could require machining in the annealed state. The surface layer of the components could be enriched with C by means of case-hardening, nitriding or carbonitriding if a very high level of surface hardness is required in the applications envisaged.

Co retards the restoration of the dislocations and therefore slows down the excessive ageing mechanisms in the hot state in the martensite. It was considered that it thus allowed a high level of tensile strength in the hot state to be maintained. On the other hand, however, it was suspected that, since Co promotes the formation of the above-mentioned μ phase which is what hardens the maraging steels of the prior art having Fe—Ni—Co—Mo, the significant presence thereof contributed to reducing the quantity of Mo and/or W available for forming $M_2C$ carbides which contribute to the hardening in accordance with the mechanism which it is desirable to promote.

On the other hand, cobalt slightly raises the ductile/brittle transition temperature, which is not advantageous, in particular in compositions having contents of nickel which are rather low, whilst, contrary to what has been able to be found in other steels, cobalt does not evidently raise the transformation point Ms of the compositions of the invention and therefore does not have any clear advantage in this regard either.

The content of Co (from 5 to 7%) proposed in the steels of WO-A-2006/114499, in combination with the contents of the other elements, was a result of the search for a compromise between these various advantages and disadvantages.

However, the inventors have found that, in contrast to the current prejudices of metallurgists who are specialists in the field of the invention, the presence of cobalt was not indispensable to obtaining, in particular, a high level of mechanical strength in maraging steels with duplex hardening. Its absence may even have the advantage of providing a better compromise between the tensile strength Rm and the toughness Kv. However, it must go together with tolerances which are linked to the contents of some impurities and preferably with an adjustment of the contents of some elements which ensure a sufficiently high measured temperature Ms.

Ni and Al are linked in the invention, in which Ni must be ≥7+3.5 Al. These are the two essential elements which are involved in a significant part of the age-hardening, owing to the precipitation of the nanometric intermetallic phase of the type B2 (NiAl, for example). It is this phase which confers a significant part of the mechanical strength in the hot state, up to approximately 400° C. Nickel is also the element which reduces the cleavage brittleness since it reduces the ductile/brittle transition temperature of martensites. If the level of Al is too high compared with Ni, the martensitic matrix is too highly depleted in terms of nickel following the precipitation of the hardening precipitate NiAl during the ageing. This inhibits the criteria of toughness and ductility since lowering the nickel content in the martensitic phase leads to the increase of the ductile/brittle transition temperature thereof, therefore to its embrittling at temperatures close to ambient temperature. In addition, nickel promotes the formation of reverted austenite and/or stabilises the residual austenite fraction (which may be present) during the ageing cycle. These mechanisms promote the criteria of ductility and toughness but also structural stability of the steel. If the aged matrix is excessively depleted in terms of nickel, these characteristic mechanisms are impaired or inhibited: there is no longer any potential for reverted austenite. On the other hand, if there is an excessive level of Ni, the level of the hardening phase of the NiAl type is excessively reduced by exaggerating the level of reverted austenite in which Al remains largely in solution.

At the end of the annealing, there must be no residual austenite (<3%), and a substantially martensitic structure must be left behind. To this end, it is necessary to adjust the annealing conditions, in particular the temperature of the end of cooling, and also the composition of the steel. This determines the temperature Ms of the beginning of martensitic transformation which, according to the invention, must preferably remain equal to or greater than 140° C. if there is no cryogenic cycle, and must preferably be equal to or greater than 100° C. if there is a cryogenic cycle.

Ms is conventionally calculated in accordance with the conventional formula from the documentation: Ms=550−350×C %−40×Mn %−17×Cr %−10×Mo %−17×Ni %−8×W %−35×V %−10×Cu %−10×Co %+30×Al %° C. However, experiments have shown that this formula is only very approximate, in particular since the effects of Co and Al are very variable from one type of steel to another. In order to know whether or not a steel complies with the invention, therefore, measurements of the actual temperature Ms must be taken as a basis, carried out, for example, by means of dilatometry in conventional manner. The content of Ni is one of the possible adjustment variables of Ms.

The temperature of the end of cooling after annealing must be less than actual Ms−150° C., preferably less than actual Ms−200° C. in order to provide a complete martensitic conversion of the steel. For the compositions which are the most enriched with C and Ni in particular, this temperature of the end of cooling can be obtained following a cryogenic treatment which is applied immediately following a cooling to ambient temperature from the solution heat treatment temperature. It is also possible to apply the cryogenic treatment not from ambient temperature, but instead after isothermic annealing which terminates at a temperature which is a little higher than Ms, preferably between Ms and Ms+50° C. The global cooling rate must be the highest possible in order to prevent the stabilisation mechanisms of the residual austenite which is rich in carbon. However, it is not always very advantageous to seek cryogenic temperatures of less than −100° C. since the thermal agitation of the structure may become insufficient at that location to produce the martensitic conversion. Generally, it is preferable for the value Ms of the steel to be greater than or equal to 100° C. if a cryogenic cycle is applied and greater than or equal to 140° C. in the absence of this cryogenic cycle. The duration of the cryogenic cycle, if necessary, is between 4 and 50 hours, preferably from 4 to 16 hours, and more preferably from 4 to 8 hours. It is possible to carry out a plurality of cryogenic cycles, the significant factor being that at least one of them has the above-mentioned characteristics.

There must be Al=1-2%, preferably 1-1.6%, more preferably 1.4-1.6%, and Ni=11-16%, with Ni≥7+3.5 Al. Ideally, there is 1.5% of Al and 12-14% of Ni. These conditions promote the presence of NiAl which increases the tensile strength $R_m$ which has also been found not to have deteriorated excessively with the absence of Co if the other conditions of the invention are combined. The yield strength $R_{p0.2}$ is influenced in the same manner as $R_m$.

Compared with the steels known from U.S. Pat. No. 5,393,388, where a high presence of reverted austenite is sought in order to have a high level of ductility and toughness, the steels in the class of the invention promote the presence of hardening B2 phases, in particular NiAl, in order to obtain a high level of mechanical strength in the hot state. Compliance with the conditions relating to Ni and Al which have been set out ensures an adequate potential content of reverted austenite in order to preserve an appropriate ductility and toughness for the envisaged applications.

It is possible to add B, but no more than 30 ppm so as not to degrade the properties of the steel.

It is also possible to add Nb in order to control the size of the grains during a forging operation or another conversion in the hot state, at a content which does not exceed 0.1%, preferably which does not exceed 0.05% in order to prevent segregations which could be excessive. The steel according to the invention therefore accepts raw materials which may contain non-negligible residual contents of Nb.

A characteristic of the steels of the class of the invention is also the possibility of replacing at least some of the Mo with W. At an equivalent atomic fraction, W segregates less at solidification than Mo and provides an increase of mechanical strength in the hot state. It has the disadvantage of being costly and it is possible to optimise this cost by associating it with Mo. As has been stated, Mo+W/2 must be between 1 and 4%, preferably between 1 and 2%. It is preferable to retain a minimum content of Mo of 1% in order to limit the cost of the steel, particularly since the resistance at high temperature is not a primary objective of the steel of the invention.

Cu may be present at up to 1%. It is capable of being involved in the hardening using its γ phase, and the presence of Ni allows the harmful effects thereof to be limited, in particular the appearance of superficial cracks during forging of the components, which is found during the addition of copper in steels which contain no nickel. However, the presence is not indispensable at all and it may be present only in residual trace state, originating from contaminations due to the raw materials.

Manganese is not a priori advantageous for obtaining the intended properties of the steel, but it has no recognised negative effect; furthermore, its low vapour tension at temperatures of the liquid steel results in the fact that its concentration is difficult to control during production under reduced pressure and remelting under reduced pressure: the content thereof may vary in accordance with the radial and axial localisation in a remolten ingot. Since it is often present in the raw materials, and for the above reasons, the content thereof will preferably be a maximum of 0.25% and in any case limited to a maximum of 2% since excessive variations of the concentration thereof in the same product would be detrimental to the consistency of the properties.

Silicon is known to have a hardening effect in solid solution of ferrite and, in the manner of cobalt, to reduce the solubility of specific elements or specific phases in the ferrite. However, the steel according to the invention dispenses with a significant addition of cobalt and the same applies to the addition of silicon, particularly since in addition silicon generally promotes the precipitation of detrimental intermetal phases in complex steels (Laves phases, silicides . . . ). The content thereof will be limited to 1%, preferably to less than 0.25% and more preferably to less than 0.1%.

Generally, the elements which can segregate at the grain boundaries and embrittle them, such as P and S, must be controlled within the following limits: S=trace levels-20 ppm, preferably trace levels-10 ppm, more preferably trace levels-5 ppm, and P=trace levels-200 ppm, preferably trace levels-100 ppm, more preferably trace levels-50 ppm.

It is possible to use Ca as a deoxidising agent and sulphur collector, it finally being found residually (≤20 ppm). In the same manner, residues of rare earths may remain at the end (≤100 ppm) following a processing operation for refinement of the liquid metal in which they would have been used to capture O, S and/or N. Since the use of Ca and rare earths to these ends is not obligatory, these elements may be present only in trace states in the steels of the invention.

The acceptable content of oxygen is a maximum of 50 ppm, preferably a maximum of 10 ppm.

By way of example, samples of steel have been tested whose compositions (in percentages by weight) are set out in Table 1:

TABLE 1

Composition and Ms temperatures measured for the samples tested

| | A (ref.) | B (ref.) | C (ref.) | D (ref.) | E (ref.) | F (ref.) | G (ref.) | H (invention) |
|---|---|---|---|---|---|---|---|---|
| C % | 0.233 | 0.247 | 0.239 | 0.244 | 0.247 | 0.19 | 0.22 | 0.21 |
| Si % | 0.082 | 0.031 | 0.031 | 0.037 | 0.030 | 0.05 | 0.04 | 0.05 |
| Mn % | 0.026 | 0.030 | 0.033 | 0.033 | 0.030 | 0.02 | <0.03 | 0.04 |
| S ppm | 1.0 | 7.3 | 3.8 | 6.1 | 6.7 | 7 | 7 | 6 |
| P ppm | 54 | <30 | <30 | <30 | <30 | 28 | <50 | 29 |
| Ni % | 13.43 | 13.31 | 12.67 | 12.71 | 13.08 | 13.00 | 14.70 | 12.95 |
| Cr % | 2.76 | 3.08 | 3.38 | 3.38 | 3.29 | 3.66 | 3.19 | 3.17 |
| Mo % | 1.44 | 1.53 | 1.52 | 1.53 | 1.53 | 1.50 | 1.67 | 1.50 |
| Al % | 0.962 | 1.01 | 1.50 | 1.50 | 1.49 | 1.56 | 1.68 | 1.54 |
| Co % | 10.25 | 10.35 | 6.18 | 6.24 | 6.33 | 6.00 | <0.10 | <0.10 |
| Cu % | 0.014 | <0.010 | 0.011 | 0.012 | 0.011 | <0.030 | <0.020 | <0.030 |
| Ti % | <0.020 | <0.020 | <0.020 | <0.020 | <0.020 | <0.005 | 0.022 | <0.005 |
| Nb % | <0.0050 | <0.0050 | <0.0050 | <0.0050 | 0.054 | <0.005 | <0.010 | <0.005 |
| B ppm | <10 | <5 | <5 | 29 | <5 | <5 | <5 | <5 |
| Ca ppm | <50 | <50 | <50 | <50 | <50 | <10 | <10 | <10 |
| N ppm | <3 | 13 | 13 | 12 | 14 | 3 | 28 | <3 |
| O ppm | <3 | 4.8 | 3.4 | 4.4 | 7.7 | <3 | 7.5 | <3 |
| V % | <0.010 | 0.252 | 0.245 | 0.254 | 0.253 | 0.006 | 0.208 | 0.250 |
| Ms measured ° C. | — | 188 | 176 | 140 | 141 | 186 | 90 | 187 |

The content of Co<0.10% of the samples G and H corresponds to the conventional precision limit of the analysis of this element. In the two instances, no intentional addition of Co has been carried out.

The elements not cited in the table are present at most only at trace levels resulting from the production operation.

The reference steel A corresponds to a steel in accordance with U.S. Pat. No. 5,393,388, therefore having a high content of Co.

The reference steel B corresponds to a steel which is comparable with steel A, to which V has been added without modifying the content of Co.

The reference steel C corresponds to a steel in accordance with WO-A-2006/114499 in particular in that, compared with the steels A and B, the Al content thereof has been increased and the Co content thereof has been decreased.

The reference steel D, compared with C, has been subject to an addition of B.

The reference steel E, compared with C, has been subject to an addition of Nb.

The reference steel F is distinguished from C substantially by the absence of a significant addition of V, compensated for by a lower content of C and a greater purity in terms of residual elements.

The reference steel G is distinguished from F by a very low content of Co which would be in accordance with the invention, the presence of V at a level comparable with that of C, D and E and a higher content of Ni but which, taken in isolation, would nonetheless be in accordance with the invention. However, the contents of Ti and N thereof are slightly greater than the invention permits. Experiments have also shown that the measured temperature Ms thereof is substantially too low compared with the requirements of the invention, the relatively high content of Ni not being compensated for by contents of Cr, Mo, Al and V which would be relatively low.

The steel H is in accordance with the invention in all respects, in particular the very low content of Co and the high level of purity thereof in terms of N and Ti. Also, the O content thereof is very low. Finally, the measured temperature Ms thereof is completely in accordance with the invention.

These samples were forged from ingots of 200 kg into flat bars of 75×35 mm under the following conditions. A homogenisation treatment of at least 16 hours at 1250° C. is followed by a first forging operation which is intended to split the coarse structures of the ingots; semi-finished products having a cross-section of 75×75 mm were then forged after being brought to temperature at 1180° C.; finally, each semi-finished product was placed in an oven at 950° C., and was then forged at this temperature into the form of flat bars of 75×35 mm whose granular structure is refined by these successive operations.

Furthermore, the samples were subjected to a softening tempering operation at a temperature of at least 600° C. Experiments have shown that it is necessary in order to obtain a complete recrystallisation of the steel during the solution heat treatment which will follow. In this instance, the softening tempering operation was carried out at 650° C. for 8 hours and followed by cooling in air. Consequently, the coarse products of thermomechanical transformations may be subjected, with no specific problems, to the finishing operations (rectification, scalping, machining . . . ) which confer the definitive shape on the component.

After the forging and the softening tempering operation, the samples were subject to:

- solution heat treatment at 935° C. for 1 hour, then cooling by means of oil quenching;
- a cryogenic processing operation at −80° C. for 8 hours; specifically for the sample H, another cryogenic processing operation has been added at −120° C. for 2 hours;

a stress relieving annealing operation of 16 hours at 200° C.;

an age-hardening operation at 500° C. for 12 hours, then cooling in air.

The properties of the samples (tensile strength $R_m$ in the longitudinal direction, yield strength $Rp_{0.2}$, extension A5d, striction Z, strength KV, toughness K1c, ASTM grain size) are set out in table 2. In this instance, they are measured at normal ambient temperature.

TABLE 2

Properties of the samples tested

| | $R_m$ (Mpa) | $Rp_{0,2}$ (Mpa) | A5d (%) | Z (%) | KV (J) | K1c (MPa Vm) | Grain ASTM |
|---|---|---|---|---|---|---|---|
| A | 2075 | 1915 | 11.5 | 59 | 26/30 | 57 | 8 |
| B | 2115 | 1963 | 11.3 | 60 | 27/27 | 57.1 | 8 |
| C | 2274 | 1982 | 10.6 | 54 | 23/24 | 43.5 | 8 |
| D | 2286 | 1970 | 10.9 | 56 | 20/23 | 44.3 | 8 |
| E | 2270 | 1961 | 10.3 | 52 | 21/24 | 46.6 | 9 |
| F | 2060 | 1904 | 10.4 | 59 | 21/23 | 59 | 7 |
| G | 2149 | 1715 | 10.2 | 52 | 28/28 | — | 7 |
| H | 2077 | 1866 | 10.9 | 62 | 34/35 | 70.4 | 7 |

It can be seen that the reference samples C, D and E have a tensile strength which is much greater than that of the reference samples A and B. The yield strength is at least of the same order of magnitude. Unlike that increase of the tensile strength, the properties concerning ductility (striction and extension at break), toughness and resilience are decreased, in the case of the thermal processing operations described and used. The desired compromise between strength/toughness can be adjusted by means of a modification of the ageing conditions.

The reference sample B shows that addition of only V to steel A brings about only an improvement in some properties, and at proportions which are most often less substantial than in the case of steels C to H having a content of Co which is reduced or zero.

In particular, the increase in Al, in steels C to H, together with a high content of Ni being maintained, makes the hardening phase NiAl more pronounced and is a significant factor in the improvement in the tensile strength or in maintaining it at an advantageously high value.

The additions of B and Nb of the samples D and E are not necessary in order to obtain the high mechanical strengths sought mainly in steels of the class of the invention, respectively. However, the addition of Nb allows the size of the grain to be refined, described by the conventional ASTM index (the highest ASTM values corresponding to the finest grains).

After the softening tempering at 650° C. for 8 hours and cooling under air, a solution heat treatment at 935° C. for 1 hour followed by cooling in oil, then cryogenic processing at −80° C. for 8 hours, then stress relief at 200° C. for 8 hours (on the tensile samples) or 16 hours (on the resilience samples in order to facilitate machining of the V notch of the Charpy sample; this tempering at low temperature has the only effect of softening the coarse annealing structure by a few HRC units), then ageing at 500° C. for 12 hours followed by cooling under air, allowed an excellent compromise to be obtained between tensile strength, ductility and resilience at 20° C. in the longitudinal direction.

Complementary experiments show that, in the transverse direction, the resilience values remain acceptable. At 400° C., the tensile strength remains very high and Co contents which are relatively low as in the samples C to F or, according to the invention, almost or virtually negligible, as in the samples G and H, are compatible with solving those aspects of the problems set.

The sample G shows that the great reduction, as far as total elimination, of cobalt may nevertheless allow a high level of tensile strength to be maintained. The properties of ductility, in a surprising manner, are also improved. However, the elastic limit is quite substantially worsened in the case of sample G, in relation to a larger quantity of austenite that is dispersed in the structure, owing to the high content of Ni of that sample. This contributes to an excessive reduction in the Ms measured which is not compensated for by adjustments to the contents of the other elements.

In the case of sample H, however, which corresponds to the composition according to the invention in all respects and whose temperature Ms is sufficiently high, there is obtained:

a tensile strength which remains high and which could be, if necessary, further improved by an increase in the C content which would promote hardening by annealing and formation of secondary carbides; tensile strength in the order of 2300 MPa would thereby be accessible for a content of C of approximately 0.25%;

a yield strength which is substantially improved over sample G;

and in particular properties of ductility which are remarkable and greater than those of all the reference samples, allowing a good compromise to be brought about between tensile strength and toughness, this characteristic being very important in the context of the preferred applications which are envisaged for the steel of the invention.

The contents of N and Ti which are slightly too high in the sample G in relation to the requirements of the invention, and also the content thereof in terms of oxygen which is slightly higher, also contribute partially to the fact that its effectiveness is not as good as that of the sample H. Another factor to be considered for this sample G is a content of S which is not particularly low and which tends to lessen the toughness if it is not compensated for by other characteristics which would be favourable for this property. Finally, as has been set out, this sample G has a content of Ni which is quite high (though remaining within the scope of the invention), which lowers Ms and therefore promotes the maintenance of a level of residual austenite which is possibly too high, even at the end of the cryogenic processing operation which is more particularly promoted (at −80° C. then at −120° C.) and which this sample has undergone.

However, the sample H according to the invention which has been processed cryogenically only at −80° C., but which has a content of Ni which is judiciously adjusted, minimal contents of impurities from all perspectives and a measured temperature Ms which is sufficiently high, complies very well with the problems set out.

Generally, an optimised thermal processing method for the steel according to the invention for finally obtaining a component having the desired properties is, after the shaping of the blank of the component and before the finishing operation conferring on the component its definitive shape:

softening tempering at from 600-675° C. for from 4 to 20 hours followed by cooling under air;

solution heat treatment at from 900-1000° C. for at least 1 hour, followed by cooling in oil or under air which is sufficiently rapid to avoid precipitation of intergranular carbides in the austenite matrix;

if necessary, a cryogenic processing operation at −50° C. or lower, preferably at −80° C. or lower, in order to convert all the austenite into martensite, the temperature being lower than Ms by 150° C. or more, preferably lower than Ms by approximately 200° C., at least one of the cryogenic processing operations lasting at least 4 hours and a maximum of 50 hours; for the compositions having in particular a content of Ni which is relatively low and which results in a relatively high temperature Ms, this cryogenic processing operation is less advantageous;

optionally, softening processing of the coarse martensite involving annealing carried out at 150-250° C. for from 4 to 16 hours, followed by cooling under still air;

hardening ageing at 475-600° C., preferably at from 490-525° C. for from 5 to 20 hours; ageing below 490° C. is not always recommended because the metastable carbide $M_3C$ could still be present and would confer fragility on the structure; ageing operations above 525° C. may bring about a loss of mechanical strength owing to ageing, without any substantial increase in toughness or ductility.

In the examples which have been described, the operations for shaping the steel following its casting and before the softening tempering and the other thermal processing operations involved forging. However, other types of thermomechanical processing operations for hot-shaping can be carried out in addition to or in place of that forging operation, in accordance with the type of final product which it is desirable to obtain (swaged components, bars, semifinished products . . . ). It is particularly possible to set out one or more rolling operations, swaging, stamping, etc., and a combination of a plurality of such processing operations.

The preferred applications of the steel according to the invention are endurance components for engineering and structural elements, for which it is necessary to have, in the cold state, a tensile strength of between 2000 MPa and 2350 MPa or more, combined with values for ductility and resilience which are at least equivalent to those of the better high-strength steels and, in the hot state (400° C.), a tensile strength in the order of 1800 MPa, and optimum fatigue properties.

The steel according to the invention also has the advantage of being able to be case-hardened, nitrided and carbonitrided. It is therefore possible to confer on the components which use it a high level of abrasion resistance without affecting the core properties thereof. That is particularly advantageous in the envisaged applications set out. Other surface processing operations, such as mechanical processing operations which limit the onset of fatigue fissuring from superficial defects, may be envisaged. Shot peening is one example of such processing.

If nitriding is carried out, it may be carried out during the ageing cycle, preferably at a temperature of from 490° C. to 525° C. and for a period which may be from 5 to 100 hours, the longest ageing operations bringing about progressive structural softening and, consequently, a progressive reduction in the maximum tensile strength.

Another possibility is to carry out case-hardening, nitriding or carbonitriding during a thermal cycle before or at the same time as the solution heat treatment, the steel substrate of the invention retaining all its potential in terms of mechanical properties in this case.

The invention claimed is:

1. Method for producing a component from steel, wherein the steel comprises the following steps prior to the finishing of the component which confers the definitive shape thereon:

the preparation of a steel having a composition, in percentages by weight:

C=0.20 to 0.30%

Co=trace levels to 1%

Cr=2 to 5%

Al=1 to 2%

Mo+W/2=1 to 4%

V=trace levels to 0.3%

Nb=trace levels to 0.1%

B=trace levels to 30 ppm

Ni=11 to 16%

Si=trace levels to 1.0%

Mn=trace levels to 2.0%

Ca=trace levels to 20 ppm rare earths=trace levels to 100 ppm, if N≤10 ppm, Ti+Zr/2=trace levels to 100 ppm with Ti+Zr/2≤10×N if 10 ppm<N≤20 ppm, Ti+Zr/2=trace levels to 150 ppm O=trace levels to 50 ppm N=trace levels to 20 ppm S=trace levels to 20 ppm Cu=trace levels to 1%

P=trace levels to 200 ppm, the remainder being iron and inevitable impurities resulting from the production operation, and wherein the composition of the steel simultaneously satisfies the relationship Ni≥7+(3.5×Al);

at least one operation for shaping this steel;

a softening tempering operation at 600-675° C. for from 4 to 20 hours followed by cooling in air;

a solution heat treatment at 900-1000° C. for at least 1 hour, followed by cooling in oil or air which is sufficiently rapid to prevent the precipitation of intergranular carbides in the austenite matrix;

a hardening ageing operation at 475-600° C. for from 5-20 hours.

2. Method for producing a component from steel according to claim 1, further comprising a cryogenic processing operation at −50° C. or lower, preferably at −80° C. or lower, in order to convert all the austenite into martensite, the temperature being 150° C. or more less than measured Ms, at least one of the processing operations lasting at least 4 hours and a maximum of 50 hours.

3. Method for producing a component from steel according to claim 1, further comprising a processing operation for softening the coarse martensite involving annealing carried out at 150-250° C. for from 4-16 hours, followed by cooling in still air.

4. Method for producing a component from steel according to claim 1, wherein the component is also subjected to a carburizing operation or a nitriding or a carbonitriding operation.

5. Method for producing a component from steel according to claim 4, wherein the nitriding or carburizing operation is carried out during a thermal cycle prior to or at the same time as the solution heat treatment.

6. Method for producing a component from steel according to claim 4, wherein the nitriding operation is carried out during an ageing cycle.

7. Method for producing a component from steel according to claim 6, wherein the nitriding is carried out between 490 and 525° C. for from 5 to 100 hours.

8. Method for producing a component from steel according to claim 1, wherein the hardening ageing operation is conducted at 490-525° C. for from 5-20 hours.

9. Method for producing a component from steel according to claim 1, wherein the steel contains C=0.20 to 0.25%.

10. Method for producing a component from steel according to claim 1, wherein the steel contains Cr=2 to 4%.

11. Method for producing a component from steel according to claim 1, wherein the steel contains Al=1 to 1.6%.

12. Method for producing a component from steel according to claim 1, wherein the steel contains Mo=1 to 4%.

13. Method for producing a component from steel according to claim 1, wherein the steel contains Mo+W/2=1 to 2%.

14. Method for producing a component from steel according to claim 1, wherein the steel contains V=0.2 to 0.3%.

15. Method for producing a component from steel according to claim 1, wherein the steel contains Ni=12 to 14%, with Ni≥7+3.5 Al.

16. Method for producing a component from steel according to claim 1, wherein the steel contains Nb=trace levels to 0.05%.

17. Method for producing a component from steel according to claim 1, wherein the steel contains Si=trace levels to 0.25%.

18. Method for producing a component from steel according to claim 1, wherein the steel contains 0=trace levels to 10 ppm.

19. Method for producing a component from steel according to claim 1, wherein the steel contains N=trace levels to 10 ppm.

20. Method for producing a component from steel according to claim 1, wherein the steel contains S=trace levels to 10 ppm.

21. Method for producing a component from steel according to claim 1, wherein the steel contains P=trace levels to 100 ppm.

22. Method for producing a component from steel according to claim 1, wherein the steel contains Al=1.4 to 1.6%.

23. Method for producing a component from steel according to claim 1, wherein the steel contains Si=trace levels to 0.10%.

24. Method for producing a component from steel according to claim 1, wherein the steel contains S=trace levels to 5 ppm.

25. Method for producing a component from steel according to claim 1, wherein the component is a mechanical component or component for a structural element.

26. Method for producing a component from steel according to claim 1, wherein the mechanical component or component for a structural element is an engine transmission shaft, an engine suspension device, a landing gear element, a gearbox element or a bearing shaft.

27. Method for producing a component from steel according to claim 1, wherein a measured martensitic transformation temperature Ms thereof is greater than or equal to 100° C.

28. Method for producing a component from steel according to claim 27, wherein the measured martensitic transformation temperature Ms thereof is greater than or equal to 140° C.

* * * * *